US007591023B2

(12) United States Patent
Béland et al.

(10) Patent No.: US 7,591,023 B2
(45) Date of Patent: Sep. 22, 2009

(54) HOCKEY GLOVE

(75) Inventors: Jean-François Béland, Montreal (CA); Mathieu Contant, Verdun (CA); Jean-François Laperrière, Prévost (CA)

(73) Assignee: Bauer Hockey, Inc., Greenland, NH (US)

( * ) Notice: Subject to any disclaimer, the term of this patent is extended or adjusted under 35 U.S.C. 154(b) by 581 days.

(21) Appl. No.: 11/494,546

(22) Filed: Jul. 28, 2006

(65) Prior Publication Data

US 2008/0034469 A1 Feb. 14, 2008

(51) Int. Cl.
*A41D 19/00* (2006.01)

(52) U.S. Cl. ..... 2/161.1

(58) Field of Classification Search ..... 2/16, 2/20, 21, 161.1, 161.6
See application file for complete search history.

(56) References Cited

U.S. PATENT DOCUMENTS 5,237,703 A * 8/1993 Brine et al. ..... 2/16
5,511,242 A * 4/1996 Bianchi ..... 2/16
2005/0091721 A1* 5/2005 Best ..... 2/16
2006/0010552 A1* 1/2006 Gait ..... 2/16
2006/0130210 A1 6/2006 Gait
2006/0130211 A1 6/2006 Gait

* cited by examiner

*Primary Examiner*—Katherine Moran

(57) ABSTRACT

A hockey glove for receiving a hand of a player, the hand having a palm, a dorsal side, four fingers, each finger having palm and dorsal surfaces, lateral and medial surfaces, a proximate articulation, proximate, middle and distal phalanges with middle and distal articulations therebetween, and one thumb with palm and dorsal surfaces. The hockey glove comprises a hand receiving portion comprising: (a) a palm sheet for facing the palm of the hand and the palm surface of the fingers and thumb, the palm sheet having a palm periphery; (b) a dorsal sheet for covering the dorsal surface of the fingers, the dorsal sheet having a dorsal periphery; (c) a side finger web for facing the lateral and medial surfaces of each finger, the side finger web having an upper web periphery and a lower web periphery, the upper web periphery being connected to the dorsal periphery and the lower web periphery being connected to the palm periphery for defining first, second, third and fourth finger gussets for respectively enclosing the four fingers; and (d) a finger pad for covering at least partially the dorsal surface of one finger, the finger pad having a padding element enclosed in a pocket, the pocket comprising lateral and medial flaps extending downwardly along a portion of a length of the finger pad for connecting the pocket to one of the first, second, third and fourth finger gussets such that there is a void area between the pocket and the finger gusset.

23 Claims, 10 Drawing Sheets

HOCKEY GLOVE

FIELD OF THE INVENTION

The present invention relates to hockey gloves.

BACKGROUND OF THE INVENTION

Traditional hockey gloves have finger gussets and finger pads that are directly mounted on the finger gussets such that, for each finger gusset and finger pad, the base layer of the finger pad's pocket is also the upper layer of the finger gusset. Because there is no space between the finger pad and the finger gusset, the movement of the finger may be imparted by the finger pad. There is therefore a need for a hockey glove offering greater flexibility to the fingers of the player.

SUMMARY OF THE INVENTION

As embodied and broadly described herein, the present invention provides a hockey glove for receiving a hand of a player, the hand having a palm, a dorsal side, four fingers, each finger having palm and dorsal surfaces, lateral and medial surfaces, a proximate articulation, proximate, middle and distal phalanges with middle and distal articulations therebetween, and one thumb with palm and dorsal surfaces. The hockey glove comprises a hand receiving portion comprising: (a) a palm sheet for facing the palm of the hand and the palm surface of the fingers and thumb, the palm sheet having a palm periphery; (b) a dorsal sheet for covering the dorsal surface of the fingers, the dorsal sheet having a dorsal periphery; (c) a side finger web for facing the lateral and medial surfaces of each finger, the side finger web having an upper web periphery and a lower web periphery, the upper web periphery being connected to the dorsal periphery and the lower web periphery being connected to the palm periphery for defining first, second, third and fourth finger gussets for respectively enclosing the four fingers; and (d) a finger pad for covering at least partially the dorsal surface of one finger, the finger pad having a padding element enclosed in a pocket, the pocket comprising lateral and medial flaps extending downwardly along a portion of a length of the finger pad for connecting the pocket to one of the first, second, third and fourth finger gussets such that there is a void area between the pocket and the finger gusset.

The invention further provides a hockey glove for receiving a hand of a player, the hand having a palm, a dorsal side, four fingers, each finger having palm and dorsal surfaces, lateral and medial surfaces, a proximate articulation, proximate, middle and distal phalanges with middle and distal articulations therebetween, and one thumb with palm and dorsal surfaces. The hockey glove comprises a hand receiving portion comprising: (a) a palm sheet for facing the palm of the hand and the palm surface of the fingers and thumb, the palm sheet having a palm periphery; (b) a dorsal sheet for covering the dorsal surface of the fingers, the dorsal sheet having a dorsal periphery; (c) a side finger web for facing the lateral and medial surfaces of each finger, the side finger web having an upper web periphery and a lower web periphery, the upper web periphery being connected to the dorsal periphery and the lower web periphery being connected to the palm periphery for defining first, second, third and fourth finger gussets for respectively enclosing the four fingers, each finger gusset comprising portions of the finger web defining lateral and medial sides for facing the respective lateral and medial surfaces of the finger, a portion of the dorsal sheet defining an upper side for facing the dorsal surface of the finger and a portion of the palm sheet defining a bottom side for facing the palm surface of the finger; and (d) a finger pad for covering at least partially the dorsal surface of one finger, said finger pad having a padding element enclosed in a pocket, said pocket comprising a base layer facing a lower side of said padding element and an overlapping layer facing lateral, medial and upper sides of said padding element, said base layer having lateral and medial flaps extending downwardly along a portion of a length of said finger pad and said overlapping layer having lateral and medial flaps extending downwardly along a portion of the length of said finger pad, wherein said lateral flaps of said respective base and overlapping layers have their respective ends inserted between a portion of said lateral side of said finger gusset and a portion of said upper side of said finger gusset, wherein said medial flaps of said respective base and overlapping layers have their respective ends inserted between a portion of said medial side of said finger gusset and a portion of said upper side of said finger gusset, and wherein said ends of said lateral flaps of said respective base and overlapping layers are connected to said respective portions of said lateral and upper sides of said finger gusset and said ends of said medial flaps of said respective base and overlapping layers are connected to said respective portions of said medial and upper sides of said finger gusset such that there is a void area between said base layer of said pocket and said upper side of said finger gusset.

The invention also provides a hockey glove for receiving a hand of a player, the hand having a palm, a dorsal side, four fingers, each finger having palm and dorsal surfaces, lateral and medial surfaces, a proximate articulation, proximate, middle and distal phalanges with middle and distal articulations therebetween, and one thumb with palm and dorsal surfaces, said hockey glove comprising (a) a plurality of finger gussets, each finger gusset being adapted to receive a respective one of the fingers, each finger gusset having an upper side; and (b) a plurality of finger pads, each finger pad being mounted on a respective one of said finger gussets so as to extend over at least part of said upper side of said respective one of said finger gussets, each finger pad comprising a padding element enclosed in a pocket, said pocket having a first longitudinal end, a second longitudinal end, and a base layer that is spaced from said upper side of said respective one of said finger gussets such that there is a void area between said base layer of said pocket and said upper side of said finger gusset, said void area extending from said first longitudinal end to said second longitudinal end.

Other aspects and features of the present invention will become apparent to the persons skilled in the art upon review of the following description of embodiments of the invention in conjunction with the accompanying figures.

BRIEF DESCRIPTION OF THE DRAWINGS

A detailed description of the embodiments of the present invention is provided herein below, by way of example only, with reference to the accompanying drawings, in which.

Figure 1A:
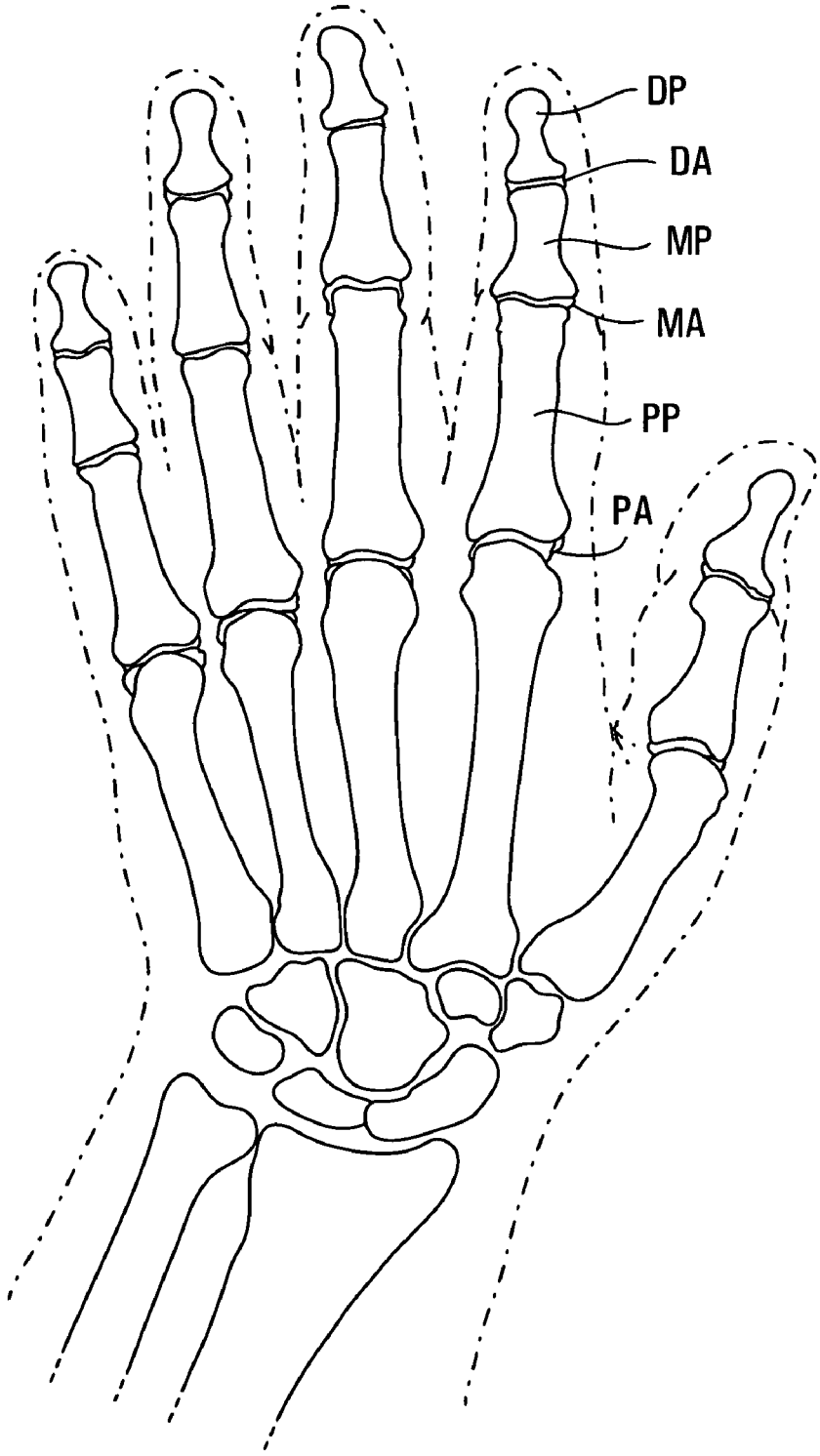
FIG. 1A is a top view of a human hand with the integument of the hand shown in broken lines and the bones shown in full lines.

In the drawings, the embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE EMBODIMENTS

To facilitate the description, any reference numerals designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Figure 1B:
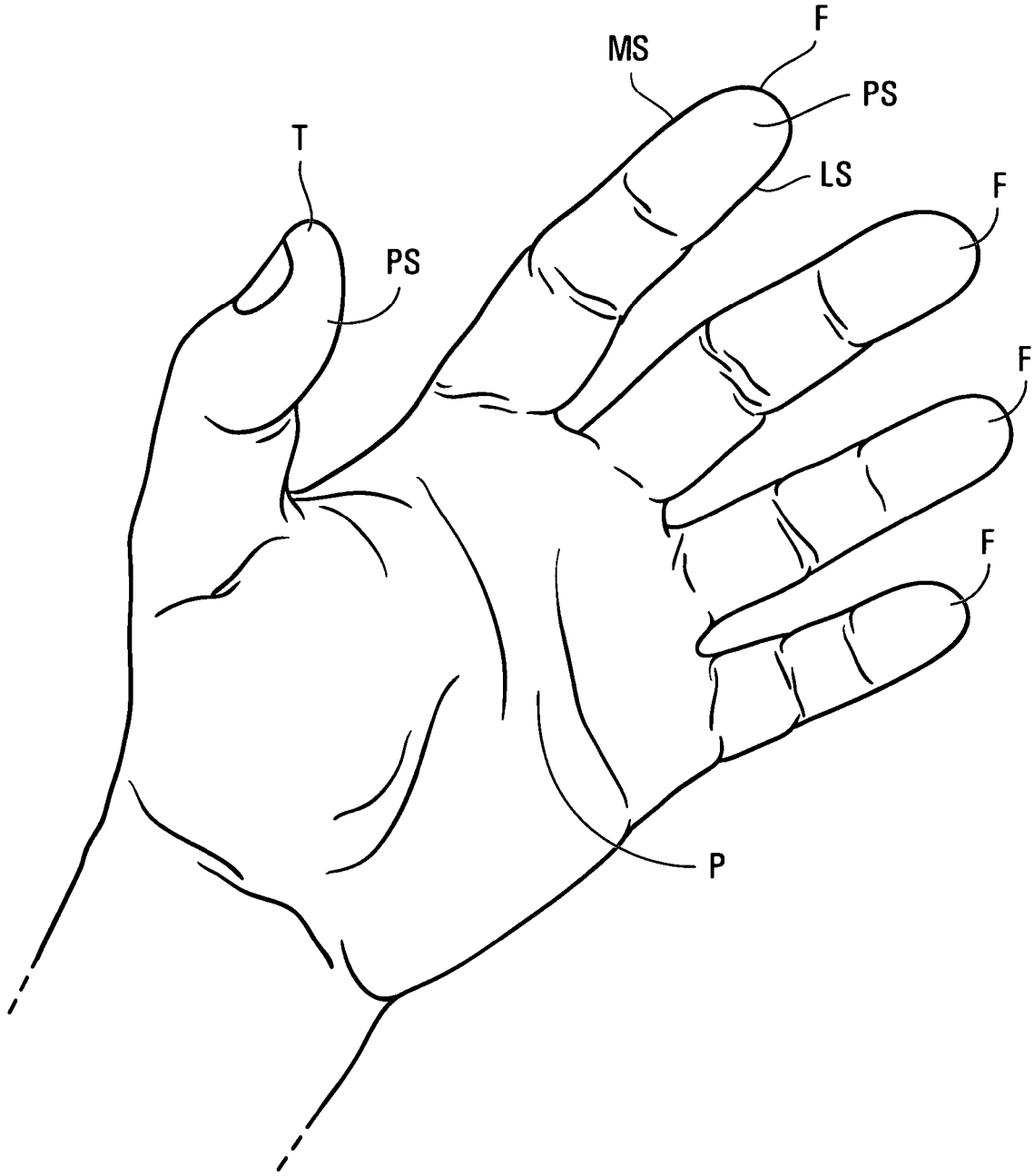
FIG. 1B is a bottom perspective view of a human hand.
Figure 1C:
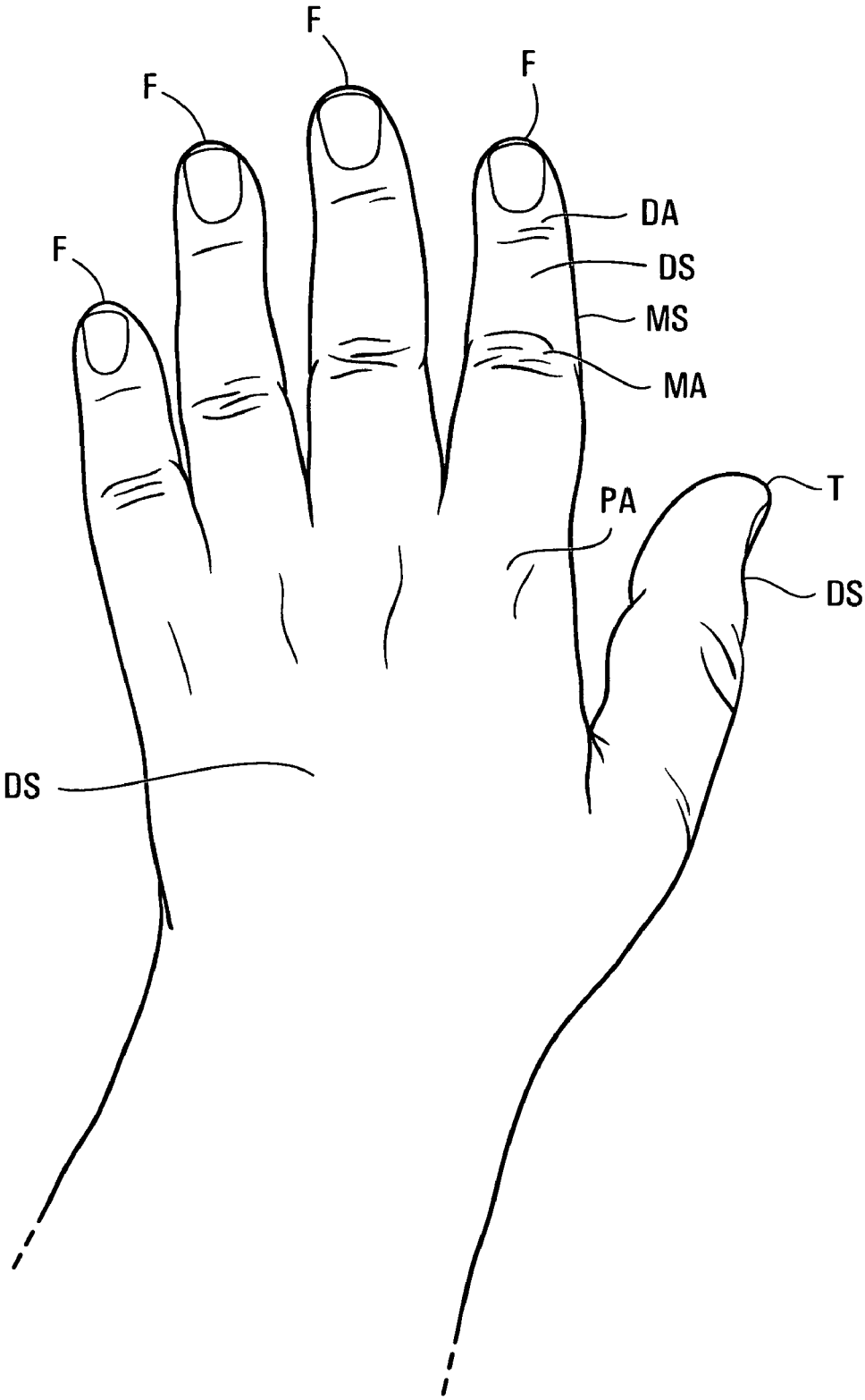
FIG. 1C is a top perspective view of the human hand of FIG. 1B.

As shown in FIGS. 1A, 1B, 1C, a human hand comprises a palm P, a dorsal side DS, four fingers F and a thumb T. Each finger F has a palm surface PS, a dorsal surface DS, a lateral surface LS, a medial surface MS, a proximate articulation PA, a proximate phalanx PP, a middle articulation MA, a middle phalanx MP, a distal articulation DA and a distal phalanx DP. The thumb T has a palm surface PS and a dorsal surface DS.

Figure 2:
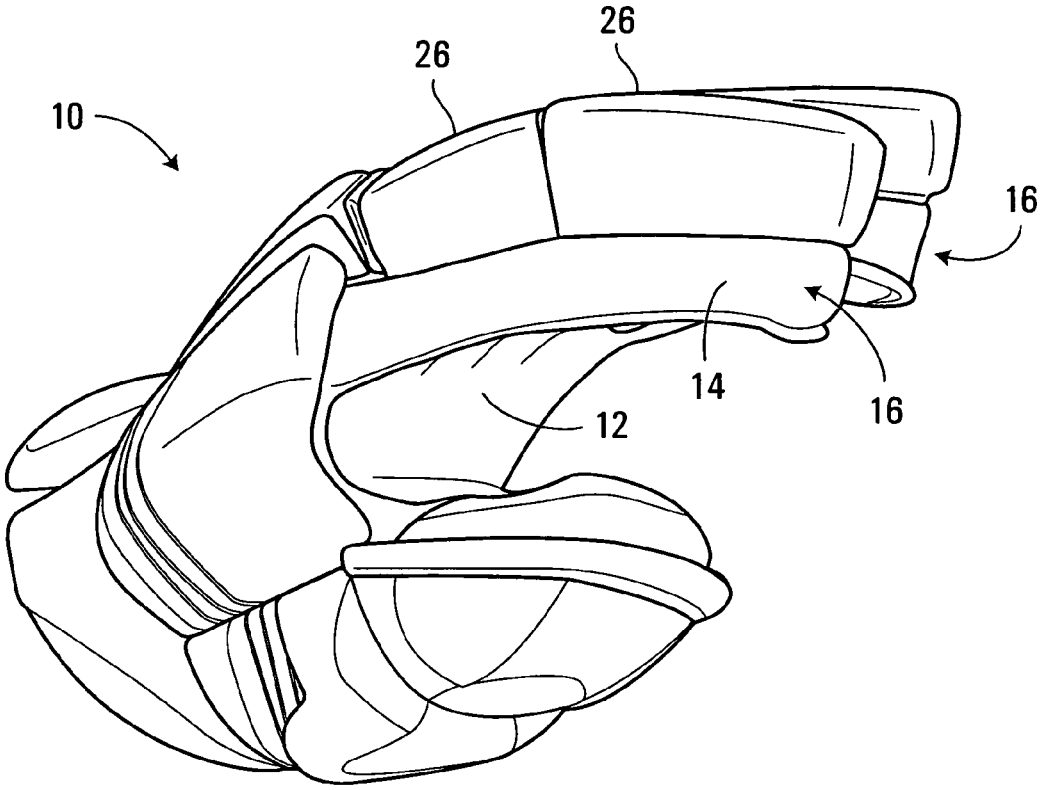
FIG. 2 (Prior Art)
FIG. 2 is a front side perspective view of a prior art hockey glove, in which the side pad protecting the side of the index finger has been removed for better illustrating the connection between the finger pads and the finger gusset of the sheath enclosing the index finger.
Figure 3:
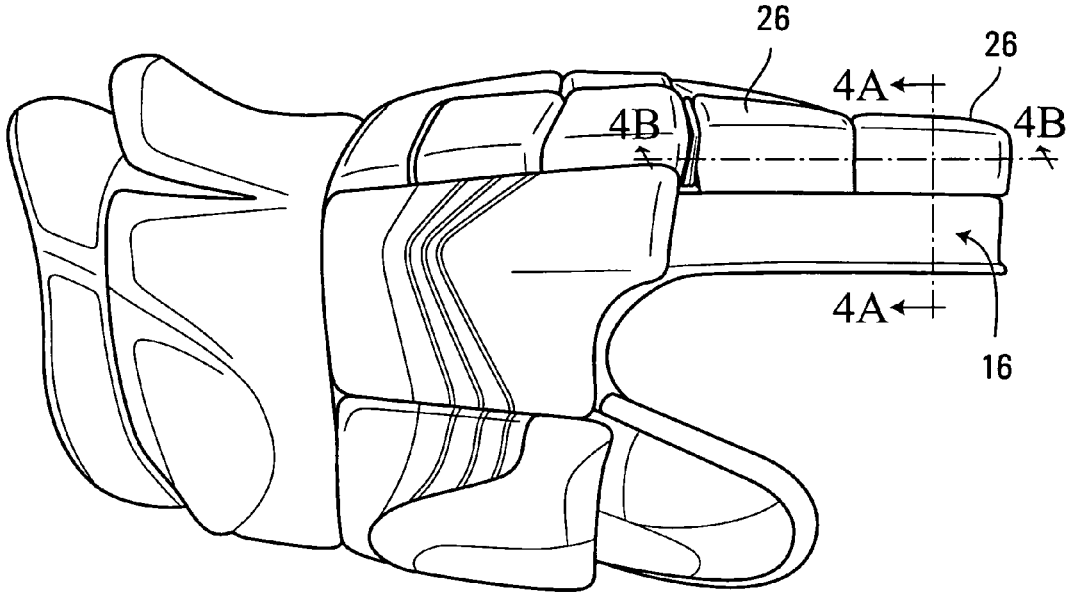
FIG. 3 (Prior Art)
FIG. 3 is a side view of the prior art glove of FIG. 2.

FIGS. 2 and 3 illustrate a prior art hockey glove 10 for receiving the hand of a player. As it is known in the art, a hockey glove has a side pad (or side pads) located adjacent the index finger and extending generally from the base of the index finger to approximately the beginning of the distal phalanx of the index finger for protecting the side portion of the index finger. In order to better illustrate the connection between the finger pads and the finger gusset, the side pad has been removed in FIGS. 2 and 3.

The hockey glove 10 has a hand receiving portion covering the palm P and dorsal side DS of the hand and extending generally to the end of the fingers F and a thumb sheath covering the thumb T. The hand receiving portion comprises a palm sheet 12 for facing the palm P and the palm surfaces PS of the respective fingers F and the palm surface PS of the thumb T and a dorsal sheet for covering the dorsal surface DS of the respective fingers F. The hand receiving portion also comprises a side finger web 14 for facing the lateral surface LS and medial surface MS of each finger F, this side finger web 14 being connected to the palm and dorsal sheets for defining finger gussets 16 for enclosing the fingers F. As it is well known in the art, pads 26, for protecting the dorsal surface DS of each finger F, cover the finger gussets 16.

Figure 4A:
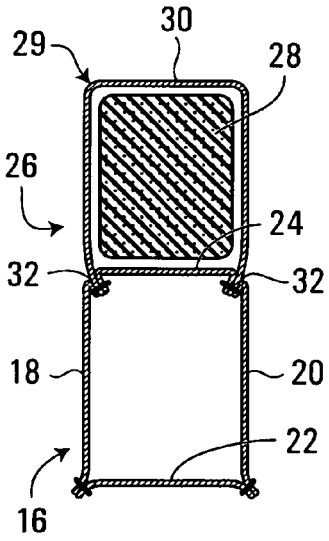
FIG. 4A (Prior Art)
FIG. 4A is an enlarged cross-sectional view taken along lines 4A-4A of FIG. 3.
Figure 4B:
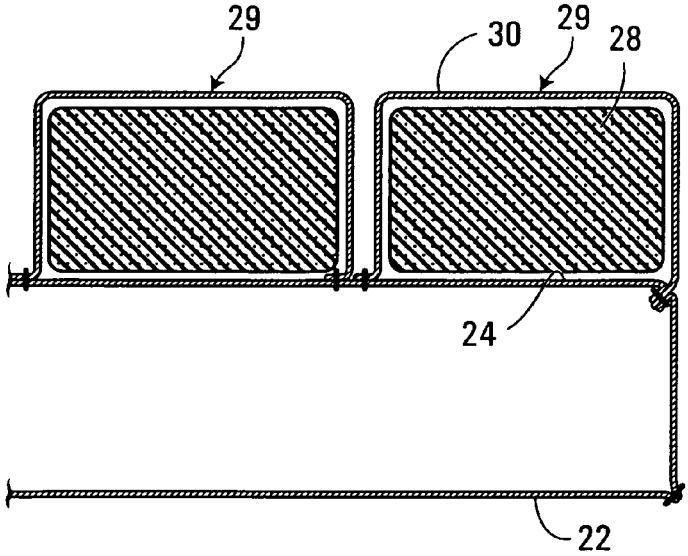
FIG. 4B (Prior Art)
FIG. 4B is an enlarged cross-sectional view taken along lines 4B-4B of FIG. 3.
Figure 5:
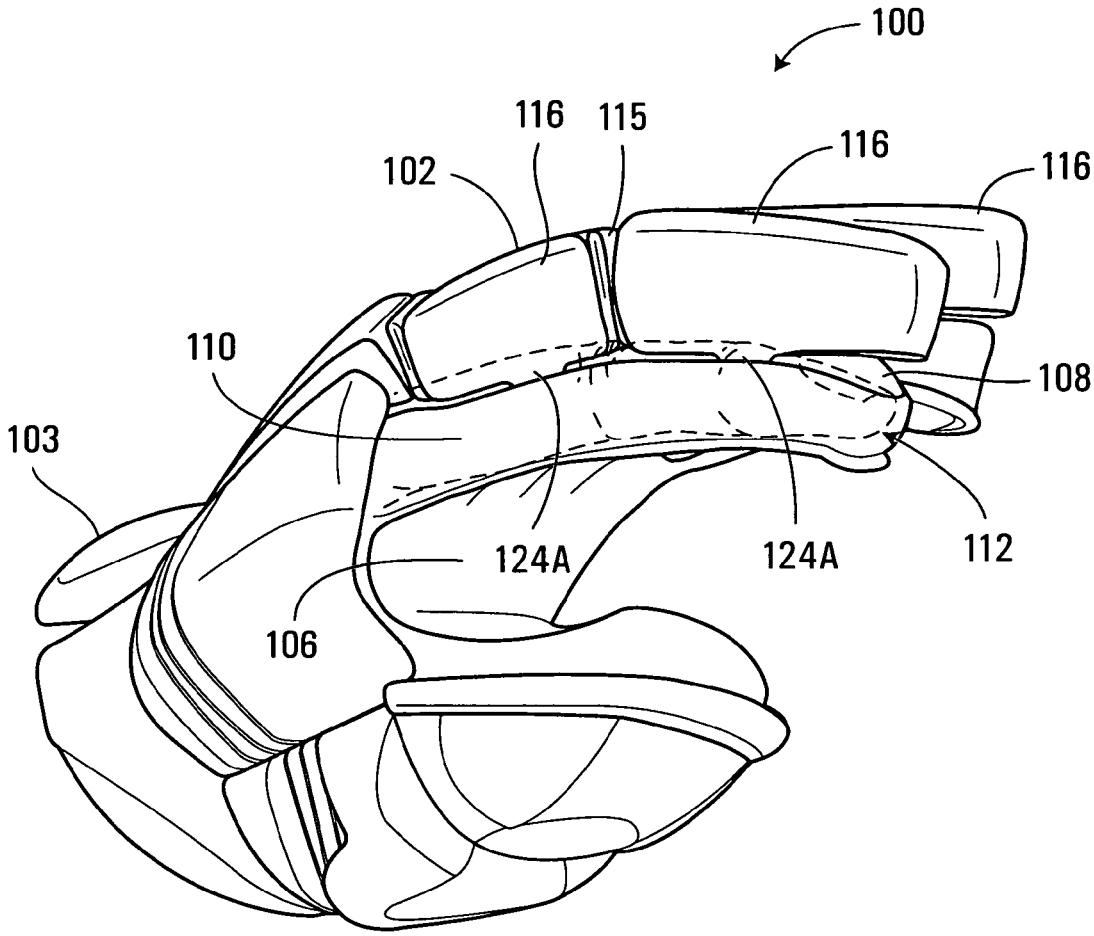
FIG. 5 is a front side perspective view of a hockey glove constructed in accordance with the invention, in which the side pad protecting the side of the index finger has been removed for better illustrating the connection between the pocket of the finger pads and the finger gusset of the sheath enclosing the index finger.

As shown in FIGS. 4A and 4B, the finger gusset 16 is made of portions of the side finger web 14 (see medial and lateral sides 18, 20), a portion of the palm sheet 12 (see bottom side 22) and a portion of the dorsal sheet (see upper side 24). The pad 26 is made of a padding element 28 enclosed in a pocket 29 formed of the upper side 24 and a layer 30 surrounding the lateral, medial and upper sides of the padding element 28. The respective ends of the medial side 18, layer 30 and upper side 24 are stitched together and the respective ends of the lateral side 20, layer 30 and upper side 24 are also stitched together (see stitches 32). It is understood that the stitches 32 are located along the length of the pad and that there are also stitches at both ends of the pad for closing the pad pocket 29. The pad pocket 29 is directly mounted on the finger gusset 16 and the side 24 serves as a base layer for the pad pocket 29 and as an upper layer for the finger gusset 16. In other words, the pad pocket 29 and the finger gusset 16 share a common layer, namely, the side 24.

Hence, in the prior art glove 10, there is no space between the pad 26 and the finger gusset 16 and the movement of the finger F may be imparted by the pad 26 due to the common layer (side 24) that serves both as a base layer for the pad pocket 29 and as an upper layer for the finger gusset 16.

FIGS. 5 to 12 illustrate a hockey glove 100 constructed in accordance with an embodiment of the invention. As it is known in the art, a hockey glove has a side pad (or side pads) located adjacent the index finger and extending generally from the base of the index finger to approximately the beginning of the distal phalanx of the index finger for protecting the side portion of the index finger. In order to better illustrate the connection between the finger pads and the finger gusset, the side pad has been removed in FIGS. 5 to 8.

The hockey glove 100 has a hand receiving portion 102 covering the palm P and dorsal side DS of the hand and extending generally to the end of the fingers F and a thumb sheath covering the thumb T. The glove 100 further comprises a cuff portion 103, which extends from the wrist up towards the lower forearm of the player, the cuff portion 103 being secured to the hand receiving portion 102 of the glove 100.

The hand receiving portion 102 comprises four finger sheaths 104 adapted to enclose the index finger, middle finger, third finger and little finger of the player. The hand receiving portion 102 also comprises a palm sheet 106 for facing the palm P and the palm surfaces PS of the respective fingers F and the palm surface PS of the thumb T. The palm sheet 106 is made of a suitable flexible material such as soft leather, leather-like materials, synthetic suede, or Nash fabric. An example of a suitable material is commercialized under the name CLARINO (trade-mark of Kuraray Co. Ltd.). The palm sheet 106 may also be treated with silicone to improve stick control and may further be reinforced with a protective layer. The hand receiving portion 102 also comprises a dorsal sheet 108 for covering the dorsal surface DS of the respective fingers F. The hand receiving portion 102 further comprises a side finger web 110 for facing the lateral surface LS and medial surface MS of each finger F. The side finger web 110 is connected to the palm sheet 106 and dorsal sheet 108 for defining finger gussets 112 for enclosing the fingers F.

Figure 6:
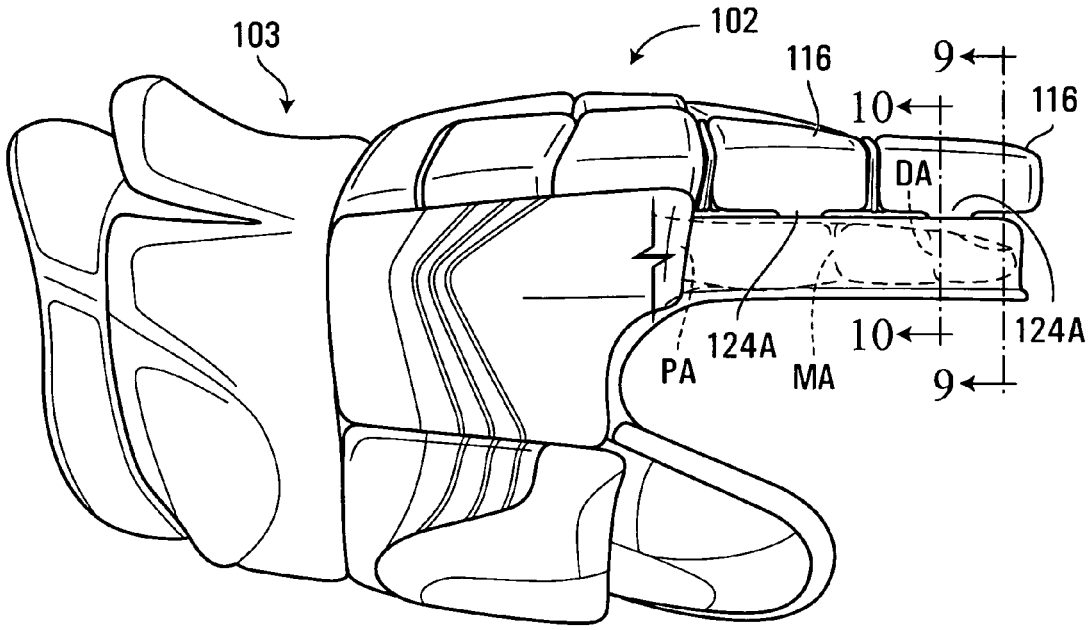
FIG. 6 is side view of the hockey glove of FIG. 5 showing the fingers in a straight position.
Figure 7:
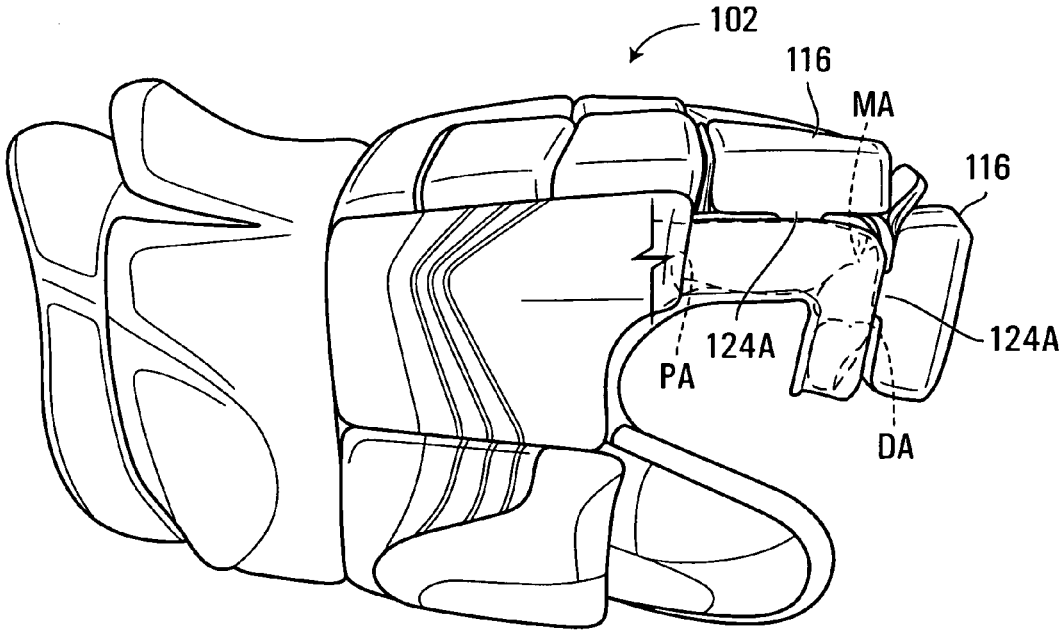
FIG. 7 is a side view of the hockey glove of FIG. 5 showing the fingers in a flexed position.
Figure 8:
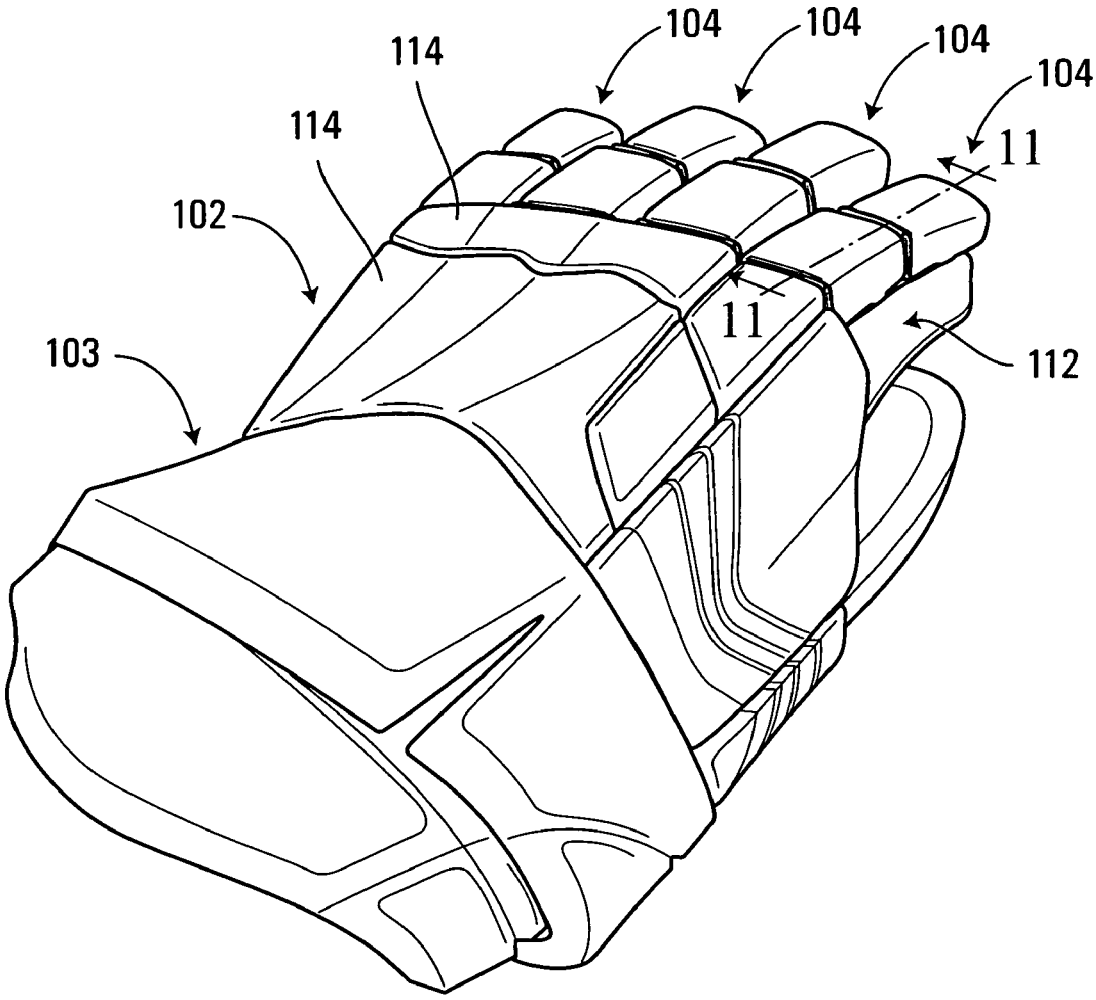
FIG. 8 is a rear side perspective view of the hockey glove of FIG. 5.

The hand receiving portion 102 also comprises dorsal pads 114 for protecting the dorsal side DS of the hand H of the player and finger pads 116 for protecting the dorsal surface DS of each finger F. While the glove 100 is shown as having, on each finger, first and second protective pads 116 and one flexion zone between these two pads 116, it will become apparent to a person skilled in the art that a variety of other patterns of protective pads/flexion zones may be used. For example, on each finger, the glove may comprise three finger pads with two flexion zones. A spacer 115 made of flexible material fills the gap between the first and second finger pads 116 of a given finger sheath 104 for covering the player's knuckles when the finger sheath 104 is fully bent inwardly (see FIG. 7). As best shown in FIGS. 6, 7 and 11, the first finger pad 116 covers at least partially the dorsal side DS of the proximate phalanx PP of the finger F and the second finger pad 116 covers at least partially the dorsal side DS of the medial phalanx MP and distant phalanx DP of the finger F. FIGS. 9 to 12 show the detailed construction of the finger pads 116 and the finger gusset 112 that encloses the index finger F.

The finger pad 116 has a padding element 118 enclosed in a pocket 120 made of a base layer 122 and an overlapping layer 124 surrounding the sides and top of the padding element 118. Examples of materials for the padding element 118 comprise polyethylene and may include various composite materials designed to absorb the energy of an impact. The padding element 118 may comprise a layer of low density padding and a layer of high density padding which overlies the low density padding. The high density padding is generally of greater density, stiffer, and less compressible that the corresponding layer of low density padding. The relative thicknesses of the layers of low and high density paddings may vary. The layers 122, 124 of the pad pocket 120 can be made of leather, knit polyester and PVC or other materials.

The finger gusset 112 is made of portions of the side finger web 110 (see medial side 110A that faces the medial surface MS of the index finger F and lateral side 110B that faces the lateral surface LS of the index finger F), a portion of the palm sheet 106 (see bottom side 106A that faces the palm surface PS of the index finger F) and a portion of the dorsal sheet 108 (see upper side 108A that faces the dorsal surface DS of the index finger F). The lower end of the medial side 110A is connected to the medial end of the bottom side 106A along the length of the finger gusset 112 (see stitches 128), and the lower end of the lateral side 110B is connected to the lateral end of the bottom side 106A along the length of the finger gusset 112 (see stitches 128).

Figure 10:
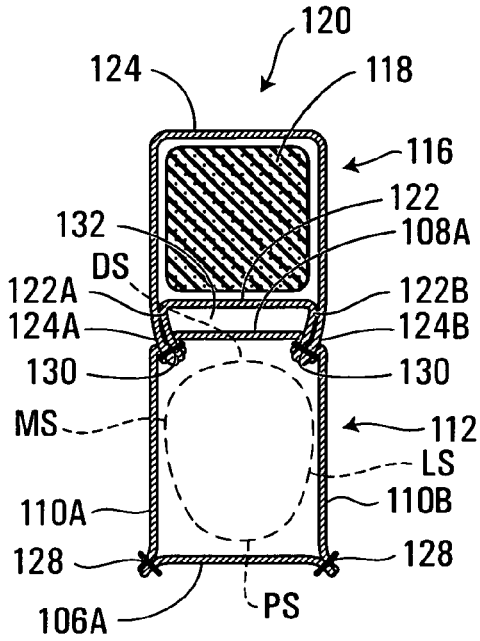
FIG. 10 is an enlarged cross-sectional view taken along lines 10-10 of FIG. 6.
Figure 11:
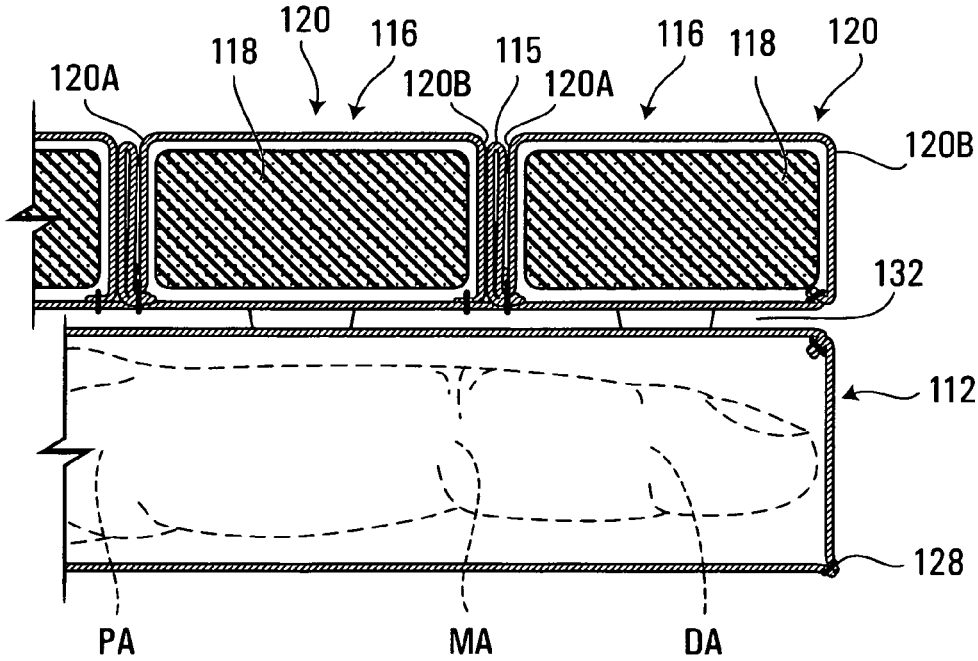
FIG. 11 is an enlarged cross-sectional view taken along lines 11-11 of FIG. 8.
Figure 12:
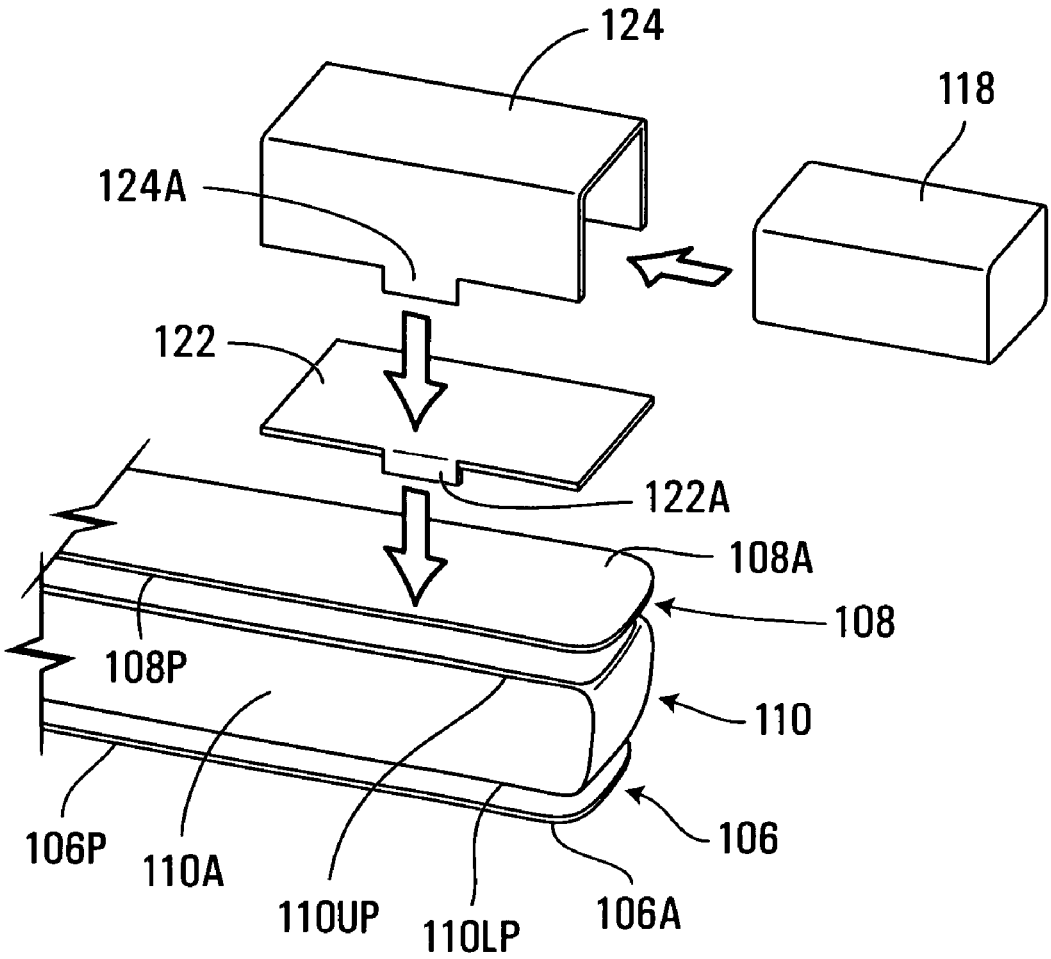
FIG. 12 is an enlarged schematic exploded view showing components of a finger sheath.

As best seen in FIGS. 10 and 12, the palm sheet 106 has a palm periphery 106P and the dorsal sheet 108 has a dorsal periphery 108P. The side finger web 110 has an upper web periphery 110UP and a lower web periphery 110LP. The base layer 122 further comprises a medial flap 122A and a lateral flap 122B extending downwardly along a portion of the length of the finger pad 116 and the overlapping layer 124 further comprises a medial flap 124A and a lateral flap 124B extending downwardly along a portion of the length of the finger pad 116. The medial flap 122A of the base layer 122 and the medial flap 124A of the overlapping layer 124 have their respective ends inserted between a portion of the medial side 110A and a portion of the upper side 108A (or, in other words, between a portion of the upper web periphery 110UP and a portion of the dorsal periphery 108P) and the lateral flap 122B of the base layer 122 and the lateral flap 124B of the overlapping layer 124 have their respective ends inserted between a portion of the lateral side 110B and a portion of the upper side 108A (or, in other words, between a portion of the upper web periphery 110UP and a portion of the dorsal periphery 108P).

Figure 9:
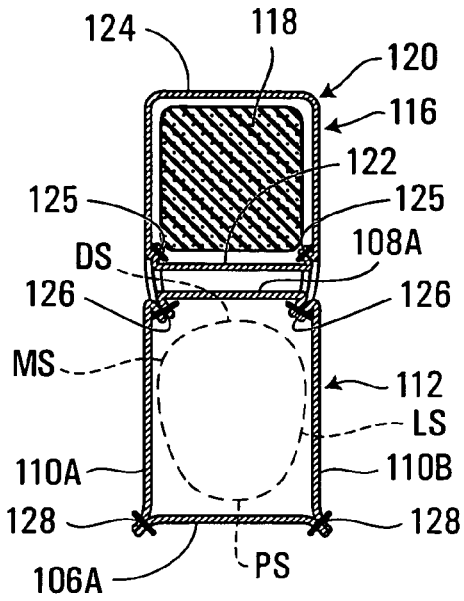
FIG. 9 is an enlarged cross-sectional view taken along lines 9-9 of FIG. 6.

The respective ends of the base layer 122 and the respective ends of the overlapping layer 124 are stitched together to form the pad pocket 120 (see stitches 125 in FIG. 9). The overlapping layer 124 is first stitched to the base layer 122 for forming the pad pocket 120, the pad pocket 120 is then turned in order to have the stitches 125 inside the pad pocket 120. The padding element 118 is inserted in the pad pocket 120, which is afterwards closed and stitched at one end, or both ends, for enclosing entirely the padding element 118.

The upper end of the medial side 110A is connected to the medial end of the upper side 108A along the length of the finger gusset 112 and the upper end of the lateral side 110B is connected to the lateral end of the upper side 108A along the length of the finger gusset 112 (see stitches 126 in FIG. 9). It is therefore understood that the upper web periphery 110UP of the side finger web 110 is connected to the dorsal periphery 108P of the dorsal sheet 108 via stitches 126 for forming the upper portion of the four finger gussets 112.

The ends of the medial flaps 122A, 124A are stitched to the respective portions of the medial side 110A and upper side 108A and the ends of the lateral flaps 122B, 124B are stitched to the respective portions of the lateral side 110B and upper side 108A (see stitches 130 in FIG. 10). It is understood that stitches 126 and stitches 130 can be the same stitches if the flaps 122A, 124A, 122B, 124B, medial, lateral and upper sides 110A, 110B, 108A of the finger gusset 112 are all simultaneously stitched together.

The flaps 122A, 124A, 122B, 124B therefore connects the finger pad 116 to the finger gusset 112 such that there is a void area 132 between the finger pad 116 (the base layer 122 of the pad pocket 120 more precisely) and the finger gusset 112 (the upper side 108A of the finger gusset 112 more precisely). Hence, the base layer 122 of the pad pocket 120 is spaced from the upper side 108A of the finger gusset 112 such that there is the void area 132 between said the base layer 122 and the upper side 108A. As best seen in FIG. 11, the void area 132 extends from a first longitudinal end 120A of the pad pocket 120 to a second longitudinal end 120B of the pad pocket 120. In order words, the void area 132 extends along the entire length of the finger pad 116.

As best seen in FIGS. 6, 7 and 11, the lateral flaps 122B, 124B and the medial flaps 122A, 124A of the first pad 116 are located proximate a region between the proximate articulation PA and middle articulation MA of the finger F and the lateral flaps 122B, 124B and the medial flaps 122A, 124A of the second pad 116 are located proximate the distal articulation DA of the finger F.

The lower web periphery 110LP of the side finger web 110 is finally connected to the palm periphery 106P of the palm sheet 106 via stitches 128 for forming the bottom portion of the four finger gussets 112 and thereby completing the construction of these finger gussets 112.

The above description of embodiments should not be interpreted in a limiting manner since other variations, modifications and refinements are possible within the spirit and scope of the present invention. The scope of the invention is defined by the appended claims and their equivalents.

The invention claimed is:

1. A hockey glove for receiving a hand of a player, the hand having a palm, a dorsal side, four fingers, each finger having palm and dorsal surfaces, lateral and medial surfaces, a proximate articulation, proximate, middle and distal phalanges with middle and distal articulations therebetween, and one thumb with palm and dorsal surfaces, said hockey glove comprising a hand receiving portion comprising:

(a) a palm sheet for facing the palm of the hand and the palm surface of the fingers and thumb, said palm sheet having a palm periphery;

(b) a dorsal sheet for covering the dorsal surface of the fingers, said dorsal sheet having a dorsal periphery;

(c) a side finger web for facing the lateral and medial surfaces of each finger, said side finger web having an upper web periphery and a lower web periphery, said upper web periphery being connected to said dorsal periphery and said lower web periphery being connected to said palm periphery for defining first, second, third and fourth finger gussets for respectively enclosing the four fingers; and (d) a finger pad for covering at least partially the dorsal surface of one finger, said finger pad having a padding element enclosed in a pocket, said pocket comprising lateral and medial flaps extending downwardly along a portion of a length of said finger pad for connecting said pocket to one of said first, second, third and fourth finger gussets such that there is a void area between said pocket and said finger gusset.

2. A hockey glove as defined in claim 1, wherein said lateral and medial flaps have their respective ends inserted between respective portions of said upper web periphery and said dorsal periphery and wherein said respective ends are connected to said respective portions of said upper web periphery and said dorsal periphery.

3. A hockey glove as defined in claim 1, wherein each finger gusset comprises portions of said finger web defining lateral and medial sides for facing the respective lateral and medial surfaces of the finger, a portion of said dorsal sheet defining an upper side for facing the dorsal surface of the finger and a portion of said palm sheet defining a bottom side for facing the palm surface of the finger.

4. A hockey glove as defined in claim 3, wherein said lateral flap has its end inserted between a portion of said lateral side of said finger gusset and a portion of said upper side of said finger gusset and said medial flap has its end inserted between a portion of said medial side of said finger gusset and a portion of said upper side of said finger gusset.

5. A hockey glove as defined in claim 4, wherein said end of said medial flap is connected to said respective portions of said medial and upper sides of said finger gusset and said end of said lateral flap is connected to said respective portions of said lateral and upper sides of said finger gusset.

6. A hockey glove as defined in claim 3, wherein said finger pad is a first finger pad for covering at least partially the dorsal side of the proximate phalanx and wherein said padding element, pocket, and lateral and medial flaps are first padding element, first pocket, and first lateral and medial flaps, said hockey glove further comprising a second finger pad for covering at least partially the dorsal side of the medial and distant phalanges, said second finger pad having a second padding element enclosed in a second pocket, said second pocket comprising second lateral and medial flaps extending downwardly along a portion of a length of said second finger pad for connecting said second pocket to one of said first, second, third and fourth finger gussets such that there is a void area between said second pocket and said finger gusset.

7. A hockey glove as defined in claim 6, wherein said first lateral and medial flaps of said first pocket are located proximate a region between the proximate and middle articulations of the finger and said second lateral and medial flaps of said second pocket are located proximate the distal articulation of the finger.

8. A hockey glove as defined in claim 7, wherein said first and second lateral flaps have their respective ends inserted between portions of said lateral side of said finger gusset and portions of said upper side of said finger gusset, each end of said first and second lateral flaps being connected to said respective portions of said lateral and upper sides; and wherein said first and second medial flaps have their respective ends inserted between portions of said medial side of said finger gusset and portions of said upper side of said finger gusset, each end of said first and second medial flaps being connected to said respective portions of said medial and upper sides.

9. A hockey glove as defined in claim 8, wherein said first and second pockets comprise respective first and second base layers facing a lower side of said respective first and second padding element and respective first and second overlapping layers facing lateral, medial and upper sides of said respective first and second padding element, and wherein said respective first lateral and medial flaps are made of portions of said respective first base and overlapping layers of said first pocket and said respective second lateral and medial flaps are made of portions of said respective second base and overlapping layers of said second pocket.

10. A hockey glove as defined in claim 9, further comprising a flexible spacer between said first and second finger pads.

11. A hockey glove as defined in claim 1, wherein said void area extends along the entire longitudinal length of said finger pad.

12. A hockey glove for receiving a hand of a player, the hand having a palm, a dorsal side, four fingers, each finger having palm and dorsal surfaces, lateral and medial surfaces, a proximate articulation, proximate, middle and distal phalanges with middle and distal articulations therebetween, and one thumb with palm and dorsal surfaces, said hockey glove comprising a hand receiving portion comprising:

(a) a palm sheet for facing the palm of the hand and the palm surface of the fingers and thumb, said palm sheet having a palm periphery;

(b) a dorsal sheet for covering the dorsal surface of the fingers, said dorsal sheet having a dorsal periphery;

(c) a side finger web for facing the lateral and medial surfaces of each finger, said side finger web having an upper web periphery and a lower web periphery, said upper web periphery being connected to said dorsal periphery and said lower web periphery being connected to said palm periphery for defining first, second, third and fourth finger gussets for respectively enclosing the four fingers, each finger gusset comprising portions of said finger web defining lateral and medial sides for facing the respective lateral and medial surfaces of the finger, a portion of said dorsal sheet defining an upper side for facing the dorsal surface of the finger and a portion of said palm sheet defining a bottom side for facing the palm surface of the finger; and (d) a finger pad for covering at least partially the dorsal surface of one finger, said finger pad having a padding element enclosed in a pocket, said pocket comprising a base layer facing a lower side of said padding element and an overlapping layer facing lateral, medial and upper sides of said padding element, said base layer having lateral and medial flaps extending downwardly along a portion of a length of said finger pad and said overlapping layer having lateral and medial flaps extending downwardly along a portion of the length of said finger pad, wherein said lateral flaps of said respective base and overlapping layers have their respective ends inserted between a portion of said lateral side of said finger gusset and a portion of said upper side of said finger gusset, wherein said medial flaps of said respective base and overlapping layers have their respective ends inserted between a portion of said medial side of said finger gusset and a portion of said upper side of said finger gusset, and wherein said ends of said lateral flaps of said respective base and overlapping layers are connected to said respective portions of said lateral and upper sides of said finger gusset and said ends of said medial flaps of said respective base and overlapping layers are connected to said respective portions of said medial and upper sides of said finger gusset such that there is a void area between said base layer of said pocket and said upper side of said finger gusset.

13. A hockey glove as defined in claim 12, wherein said finger pad is a first finger pad for covering at least partially the dorsal side of the proximate phalanx and wherein said padding element, pocket, and lateral and medial flaps of said respective base and overlapping layers are first padding element, first pocket, and lateral and medial flaps of respective first base and overlapping layers, said hockey glove further comprising a second finger pad for covering at least partially the dorsal side of the medial and distant phalanges, said second finger pad having a second padding element enclosed in a second pocket, said second pocket comprising a second base layer facing a lower side of said second padding element and a second overlapping layer facing lateral, medial and upper sides of said second padding element, said second base layer having lateral and medial flaps extending downwardly along a portion of a length of said second finger pad and said second overlapping layer having lateral and medial flaps extending downwardly along a portion of the length of said second finger pad for connecting said second pocket to one of said first, second, third and fourth finger gussets such that there is a void area between said second pocket and finger gusset.

14. A hockey glove as defined in claim 13, wherein said lateral and medial flaps of said respective base and overlapping layers of said first pocket are located proximate a region between the proximate and middle articulations of the finger and said lateral and medial flaps of said respective base and overlapping layers of said second pocket are located proximate the distal articulation of the finger.

15. A hockey glove as defined in claim 14, wherein said lateral flaps of said respective base and overlapping layers of said second pocket have their respective ends inserted between a portion of said lateral side of said finger gusset and a portion of said upper side of said finger gusset, said ends of said lateral flaps of said respective base and overlapping layers of said second pocket being connected to said respective portions of said lateral and upper sides; and wherein said medial flaps of said respective base and overlapping layers of said first pocket have their respective ends inserted between a portion of said medial side of said finger gusset and a portion of said upper side of said finger gusset, said ends of said medial flaps of said respective base and overlapping layers of said second pocket being further connected to said respective portions of said medial and upper sides.

16. A hockey glove as defined in claim 12, wherein said void area extends along the entire longitudinal length of said finger pad.

17. A hockey glove for receiving a hand of a player, the hand having a palm, a dorsal side, four fingers, each finger having palm and dorsal surfaces, lateral and medial surfaces, a proximate articulation, proximate, middle and distal phalanges with middle and distal articulations therebetween, and one thumb with palm and dorsal surfaces, said hockey glove comprising (a) a palm sheet for facing the palm of the hand and the palm surface of the fingers and thumb, said palm sheet having a palm periphery; (b) a dorsal sheet for covering the dorsal surface of the fingers, said dorsal sheet having a dorsal periphery; (c) a side finger web for facing the lateral and medial surfaces of each finger, said side finger web having an upper web periphery and a lower web periphery, said upper web periphery being connected to said dorsal periphery and said lower web periphery being connected to said palm periphery for defining said plurality of finger gussets, each finger gusset comprising portions of said finger web defining lateral and medial sides for facing the respective lateral and medial surfaces of the finger, a portion of said dorsal sheet defining said upper side for facing the dorsal surface of the finger and a portion of said palm sheet defining a bottom side for facing the palm surface of the finger; (d) a plurality of finger gussets, each finger gusset being adapted to receive a respective one of the fingers, each finger gusset having an upper side; and (e) a plurality of finger pads, each finger pad being mounted on a respective one of said finger gussets so as to extend over at least part of said upper side of said respective one of said finger gussets, each finger pad comprising a padding element enclosed in a pocket, said pocket having a first longitudinal end, a second longitudinal end, and a base layer that is spaced from said upper side of said respective one of said finger gussets such that there is a void area between said base layer of said pocket and said upper side of said finger gusset, said void area extending from said first longitudinal end to said second longitudinal end.

18. A hockey glove as defined in claim 17, wherein said pocket comprises lateral and medial flaps extending downwardly along a portion of a length of said finger pad for connecting said pocket to said finger gusset.

19. A hockey glove as defined in claim 18, wherein said lateral flap has its end inserted between a portion of said lateral side of said finger gusset and a portion of said upper side of said finger gusset and said medial flap has its end inserted between a portion of said medial side of said finger gusset and a portion of said upper side of said finger gusset.

20. A hockey glove as defined in claim 19, wherein said end of said medial flap is connected to said respective portions of said medial and upper sides of said finger gusset and said end of said lateral flap is connected to said respective portions of said lateral and upper sides of said finger gusset.

21. A hockey glove as defined in claim 18, wherein said finger pad is a first finger pad for covering at least partially the dorsal side of the proximate phalanx and wherein said padding element, pocket, and lateral and medial flaps are first padding element, first pocket, and first lateral and medial flaps, said hockey glove further comprising a second finger pad for covering at least partially the dorsal side of the medial and distant phalanges, said second finger pad having a second padding element enclosed in a second pocket, said second pocket comprising second lateral and medial flaps extending downwardly along a portion of a length of said second finger pad for connecting said second pocket to one of said plurality of finger gussets such that there is a void area between said second pocket and said finger gusset.

22. A hockey glove as defined in claim 21, wherein said first lateral and medial flaps of said first pocket are located proximate a region between the proximate and middle articulations of the finger and said second lateral and medial flaps of said second pocket are located proximate the distal articulation of the finger.

23. A hockey glove as defined in claim 22, wherein said first and second lateral flaps have their respective ends inserted between portions of said lateral side of said finger gusset and portions of said upper side of said finger gusset, each end of said first and second lateral flaps being connected to said respective portions of said lateral and upper sides; and wherein said first and second medial flaps have their respective ends inserted between portions of said medial side of said finger gusset and portions of said upper side of said finger gusset, each end of said first and second medial flaps being connected to said respective portions of said medial and upper sides.

* * * * *

UNITED STATES PATENT AND TRADEMARK OFFICE

CERTIFICATE OF CORRECTION

PATENT NO. : 7,591,023 B2
APPLICATION NO. : 11/494546
DATED : September 22, 2009
INVENTOR(S) : Béland et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 637 days.

Signed and Sealed this

Twenty-first Day of September, 2010

David J. Kappos

David J. Kappos
*Director of the United States Patent and Trademark Office*